US010954937B2

(12) United States Patent
Spiegl et al.

(10) Patent No.: US 10,954,937 B2
(45) Date of Patent: Mar. 23, 2021

(54) ADJUSTING DEVICE FOR AN ADJUSTING PISTON OF A VARIABLE CLEARANCE SPACE OF A RECIPROCATING COMPRESSOR

(71) Applicant: Hoerbiger Wien GmbH, Vienna (AT)

(72) Inventors: Bernhard Spiegl, Vienna (AT); Matthias Kornfeld, Brunn/Geb (AT); Andreas Schloffer, Vienna (AT)

(73) Assignee: Hoerbiger Wien GmbH, Vienna (AT)

( * ) Notice: Subject to any disclaimer, the term of this patent is extended or adjusted under 35 U.S.C. 154(b) by 1326 days.

(21) Appl. No.: 14/508,652

(22) Filed: Oct. 7, 2014

(65) Prior Publication Data

US 2015/0110657 A1 Apr. 23, 2015

(30) Foreign Application Priority Data

Oct. 18, 2013 (AT) ..... A 50675/2013

(51) Int. Cl.
*F04B 49/16* (2006.01)
*F04B 39/00* (2006.01)

(52) U.S. Cl.
CPC ..... *F04B 49/16* (2013.01); *F04B 39/0016* (2013.01)

(58) Field of Classification Search
CPC ..... F04B 39/0016; F04B 49/16; F16B 33/02; F16B 33/006; F16H 2025/249
See application file for complete search history.

(56) References Cited

U.S. PATENT DOCUMENTS 652,794 A * 7/1900 Lowe ..... F16B 19/05 411/361
1,586,278 A 5/1926 Bardenheuer
(Continued)

FOREIGN PATENT DOCUMENTS

DE 872701 C * 4/1953 ..... F16H 25/24
DE 19831940 1/2000
(Continued)

OTHER PUBLICATIONS

Machine Translation of German Patent DE 872701 C patent to Hartman.*
(Continued)

*Primary Examiner* — Peter J Bertheaud
*Assistant Examiner* — Dnyanesh G Kasture
(74) *Attorney, Agent, or Firm* — Whitmyer IP Group LLC

(57) ABSTRACT

In order to enable a continuous adjustment of the variable clearance space (1) of a reciprocating compressor (15), a threaded spindle drive with a threaded spindle nut (10) and a threaded spindle (9) is provided as an adjusting device (7), wherein the threaded spindle nut (10) is embodied as a plastic nut (20) with internal thread (24), the plastic nut (20) is arranged with an external thread (23) on an internal thread (22) of a nut carrier (21) of the threaded spindle nut (10), and the thread height (y) of the internal thread (22) of the nut carrier (21) and the thread height (x) of the external thread (25) of the threaded spindle (9) is respectively embodied with 50 to 80% of the radial thickness (d) of the plastic nut (20) and the plastic thickness is at least 15% of the thread pitch (z1) of the internal thread (24) at least in the region of the thread flanks (26) of the internal thread (24) of the plastic nut (20).

12 Claims, 4 Drawing Sheets

(56) References Cited

U.S. PATENT DOCUMENTS

Figure 1:
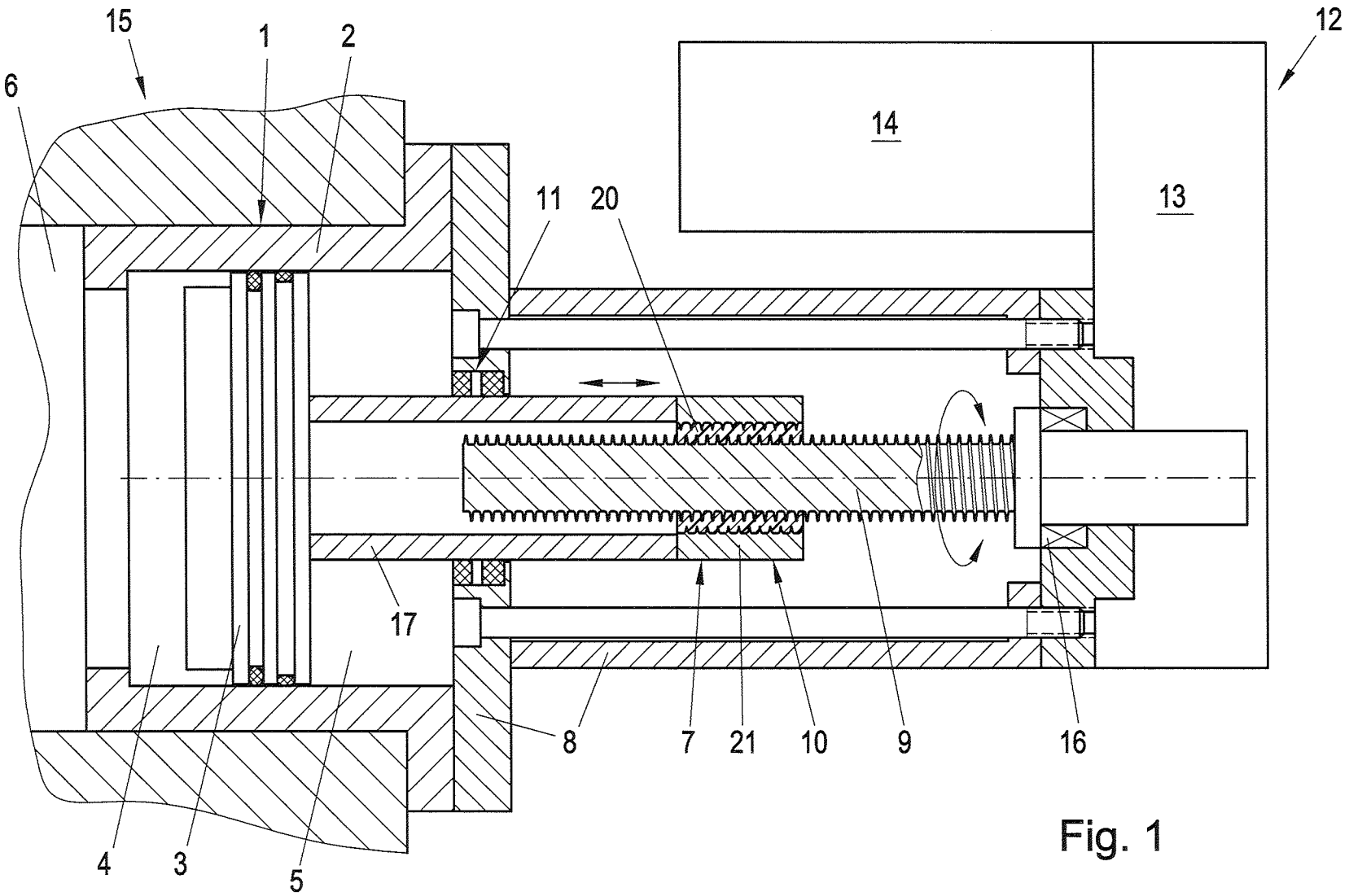

| | | | | |
|---|---|---|---|---|
| 3,643,522 | A | 2/1972 | Fullam | |
| 5,996,545 | A * | 12/1999 | Kling | F16J 9/24 123/193.6 |
| 8,430,646 | B2 | 4/2013 | Shade et al. | |
| 2009/0267040 | A1* | 10/2009 | Lautzenhiser | F04B 9/14 254/8 B |
| 2011/0020144 | A1* | 1/2011 | McClendon | F04B 17/05 417/53 |
| 2012/0017756 | A1* | 1/2012 | Bidare | F03G 7/00 92/3 |

FOREIGN PATENT DOCUMENTS

| | | |
|---|---|---|
| JP | 58178894 | 10/1983 |
| WO | 2012023463 | 2/2012 |

OTHER PUBLICATIONS

Machenery's Handbook, Published by Industrial Press in 2012, pp. 1902-1909.*
Machine Translation of German Patent DE 198 31 940 A1 to Neff, provided in Applicant's IDS.*
English Abstract of DE 19831940.
English Abstract of WO 2012023463.
English Abstract of JP 58178894.

* cited by examiner

ADJUSTING DEVICE FOR AN ADJUSTING PISTON OF A VARIABLE CLEARANCE SPACE OF A RECIPROCATING COMPRESSOR

BACKGROUND OF THE INVENTION

Field of the Invention

The present invention relates to an adjusting device for an adjusting piston of a variable clearance space of a reciprocating compressor with a threaded spindle, the threaded spindle being screwed with an external thread into an internal thread of a threaded spindle nut, and either the threaded spindle or the threaded spindle nut being displaceably arranged and the axially displaceable threaded spindle nut being connected to the adjusting piston, as well as a reciprocating compressor with such an adjusting device.

The Prior Art

The regulation of the capacity of a reciprocating compressor by means of a variable clearance space is a simple and well-tried principle. Through the adjustable clearance space, the clearance of the reciprocating compressor is reduced or enlarged. Depending on the size of the clearance space (and hence of the clearance), the rate of pressure rise and decompression of the reciprocating compressor is flattened out and the quantity of gas delivered is reduced. This type of control is associated with almost no loss and is also gladly used in addition to a flow rate control in small and medium-sized reciprocating compressors in order to coordinate the operating point of the reciprocating compressor with its drive.

Reciprocating compressors with variable clearance space are known, for example, from U.S. Pat. No. 1,586,278 A or U.S. Pat. No. 8,430,646 B2. Therein, in order to adjust the clearance of the reciprocating compressor, an adjusting piston is displaced axially in the clearance space, which communicates with the cylinder chamber. The adjustment is done manually, hydraulically, pneumatically or electrically, for example by means of an electric motor. The adjustment of the adjusting piston is done by means of a threaded spindle drive in which a threaded spindle is rotated by the drive. Either an axially displaceable threaded nut connected to the adjusting piston is arranged on the threaded spindle (U.S. Pat. No. 1,586,278 A), or the threaded spindle is connected to the adjusting piston and arranged in a stationary hole with internal thread (U.S. Pat. No. 8,430,646 B2). Furthermore, it is known to ventilate the space behind the adjusting piston in order to prevent a rise in pressure therein, which would increase the required adjusting force. Moreover, a force reversal can occur as a result of the gas pressure trapped behind the adjusting piston, resulting in increased wear in the threaded spindle as a result of the back-and-forth impact in the thread.

However, the known clearance spaces enable only occasional adjustment of the clearance. Between adjustment operations, the adjustment drive (threaded spindle) is mechanically locked in order to prevent objectionable adjustment of the clearance. In U.S. Pat. No. 8,430,646 B2, this is done, for example, by means of a hydraulic locknut that fixes the threaded spindle against rotation.

One reason for this can be found in the high pulsing load of the threaded spindle drive. Due to the way in which a reciprocating compressor works, the working pressure fluctuates quickly between suction pressure and maximum compression, which leads to a high-frequency pulsing load on the threaded spindle drive. A conventional threaded spindle drive is not designed for such strongly pulsing loads ranging from a low load (under suction pressure) and a high load (at maximum compression) and would fail in a very short time. Particularly a metallic threaded spindle in combination with a metallic thread would fail very quickly, since cold microwelds would occur at the contact points as a result of the resulting high surface compression which, in combination with the relative movement of the two surfaces, would lead to increased friction, the development of heat and, above all, wear.

Therefore, no continuous adjustment of the clearance is performed with the known systems by means of a threaded spindle drive for the flexible adaptation of the flow quantity, or it is not even possible due to the lack of fatigue strength of the threaded spindle drive. Today's systems use a threaded spindle with fixation, for example in the form of a hydraulic locknut (U.S. Pat. No. 8,430,646 B2) or a counter nut. This fixation can only be released during the adjustment operation and must be tightened again after adjustment.

However, threaded spindle drives are also known from the prior art, from DE 198 31 940 A1, for example, which use a threaded nut whose internal thread is coated with a plastic, the aim being relatively small layer thicknesses in the range from 0.1 mm to 1 mm (depending on the thread diameter). A pressure-resistant but slightly elastically deformable plastic such as polytetrafluoroethylene (PTFE), for example, is used in order to achieve greater engine smoothness, with the plastic coating acting as a damping layer against mechanical vibrations. However, such mechanical vibrations are normally low-amplitude and generally also low-frequency fluctuations in force that are superimposed over a high basic load from the drive task of the threaded spindle drive. Such a conventional threaded nut with plastic coating is, however, not designed for and also not suited to the high pulsing loads during the adjustment of the variable clearance space of a reciprocating compressor.

It is therefore the object of the present invention to provide an adjusting device for a variable clearance space that enables continuous adjustment of the clearance of a reciprocating compressor.

SUMMARY OF THE INVENTION

This object is achieved according to the invention by embodying the threaded spindle nut as a plastic nut, the plastic nut being arranged with an external thread against an internal thread of a nut carrier of the threaded spindle nut and the threaded spindle being screwed in the internal thread of the plastic nut, by embodying the thread height of the internal thread of the nut carrier and the thread height of the external thread of the threaded spindle so as to be 50 to 80%, respectively, of the radial thickness of the plastic nut, and by embodying the plastic thickness at least in the region of the thread flanks of the internal thread of the plastic nut so as to be at least 15% of the thread pitch of the internal thread. It was found that, by virtue of this design of the cooperating threads of the threaded spindle nut and the threaded spindle, the threaded spindle drive is able to withstand the high pulsing loads in a reciprocating compressor over a long duration despite the use of a plastic nut, which enables a continuous adjustment of the clearance space on the one hand and renders the fixation of the adjusting device by means of its own counter nut or clamping device like in the prior art superfluous.

The thread angle of the external thread of the threaded spindle and the thread angle of the internal thread of the nut carrier is preferable from 15 to 30°, preferably 20°, since the thread flanks then form a flexural support of approximately the same strength, which is optimum in terms of material wear with respect to the load distribution. The thread angles preferably differ by less than 5° in order to enable the best possible applied load.

To prevent unintentional unscrewing of the plastic nut from the nut carrier, the plastic nut and the nut carrier are preferably secured by an anti-torsion lock against mutual rotation.

For automatic operation, a drive unit is provided for rotating the threaded spindle or the threaded spindle nut. This also enables the incorporation of an adjusting device into a closed control loop for the continuous adjustment of the clearance space of the reciprocating compressor and hence for the continuous regulation of the capacity of the reciprocating compressor.

If a pressure equalization device is provided in the delivery piston in order to balance the pressure in the space in the delivery housing facing away from the cylinder, pressure build-up behind the delivery piston that would constitute an additional load on the adjusting device can be prevented in a simple manner. The pressure equalization device can be embodied simply as a one-way piston ring on the delivery piston, or as a non-return valve arranged in the adjusting piston, optionally together with a two-way piston ring.

BRIEF OF THE DRAWINGS

The present invention is explained below with reference to FIGS. 1 to 4, which show advantageous embodiments of the invention in exemplary, schematic and non-limiting fashion.

Figure 2A:
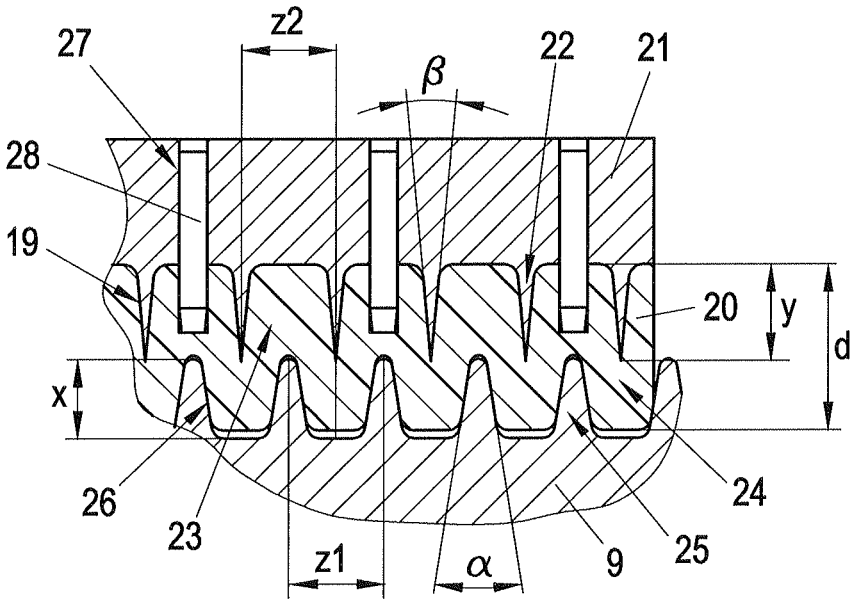
Figure 2B:
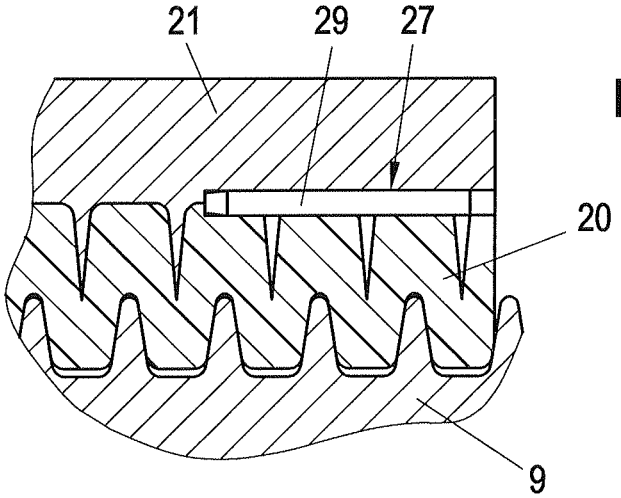
Figure 2C:
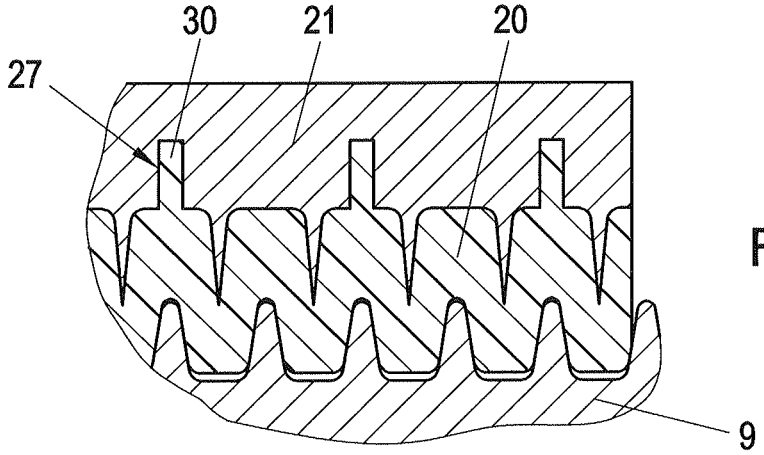
Figure 3A:
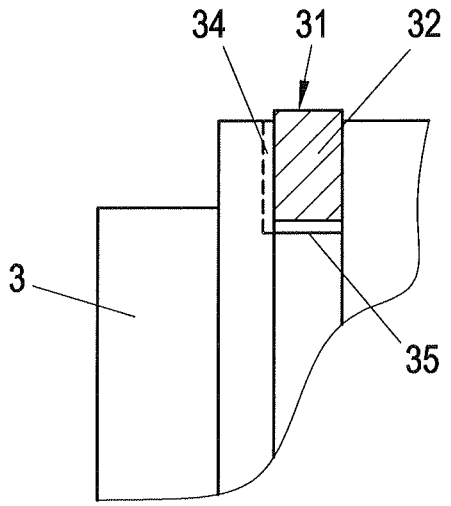
Figure 3B:
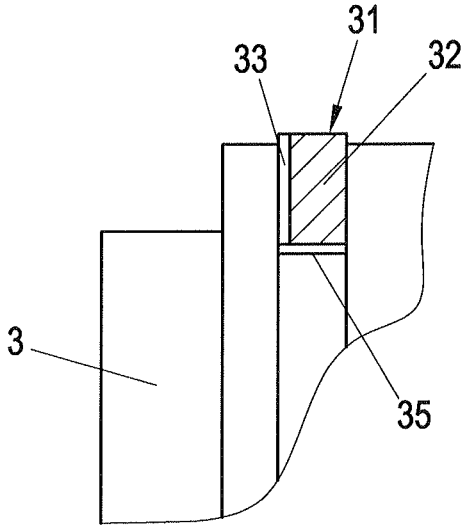
Figure 3C:
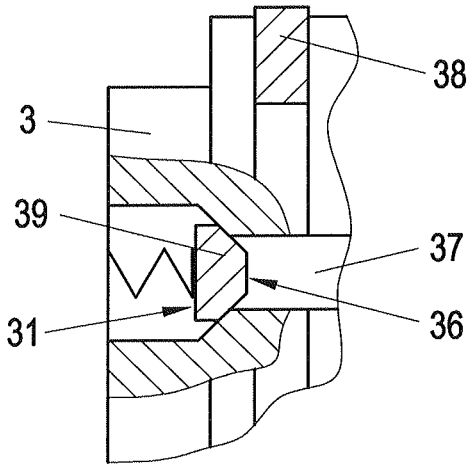
Figure 4:
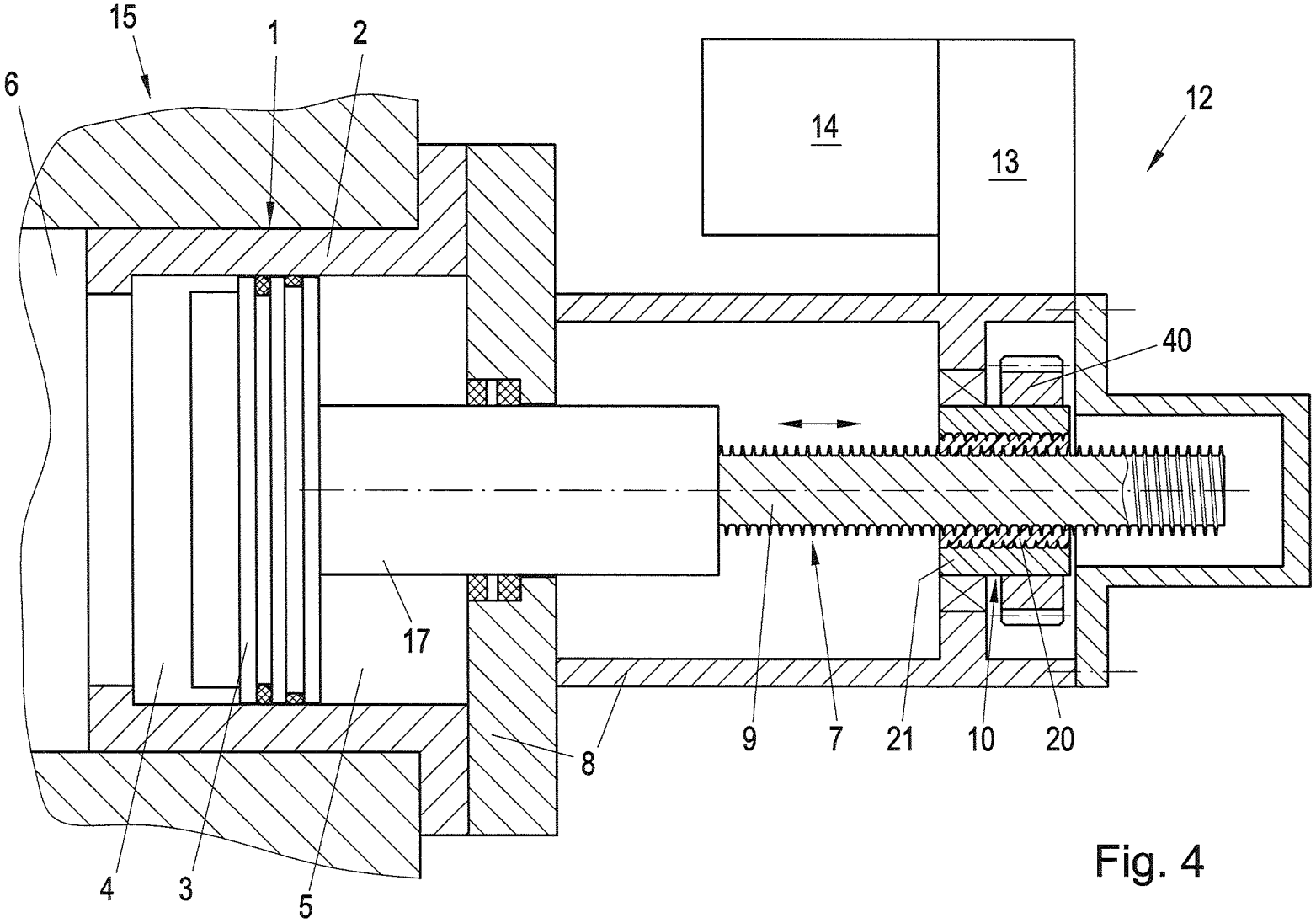

FIG. 1 shows a reciprocating compressor with clearance space and adjusting device according to the invention, FIGS. 2*a* to 2*c* show inventive embodiments of the threaded spindle nut, FIGS. 3*a* to 3*c* show possible embodiments of a pressure equilibration on the delivery piston, and FIG. 4 shows an alternative embodiment of an adjusting device of a clearance space.

DETAILED DESCRIPTION

The variable clearance space 1 according to FIG. 1 consists of a clearance space housing 2 in which an adjusting piston 3 is axially guided and is arranged in a displaceably axial manner by means of an adjusting device 7. The clearance space housing 2 is arranged in an inherently known manner on a cylinder 6 of a piston compressor 15. The space 4 facing the cylinder 6 and bordered by the adjusting piston 3 in the clearance space housing 2 communicates with the cylinder space of the piston compressor 15 and forms additional clearance of the cylinder 6.

An adjustment housing 8, in which the adjusting device 7 is arranged, is attached to the clearance space housing 2. As will readily be understood, the clearance space 1 and the adjusting device 7 can also be arranged in a common housing. The adjusting device 7 comprises a threaded spindle drive with a threaded spindle 9 that is screwed into the internal thread of a threaded spindle nut 10. The threaded spindle nut 10 is arranged in an axially displaceable manner on the threaded spindle 9 and is connected to the adjusting piston 3, for example directly or via a connecting part 17. The adjusting piston 3 is thus moved along axially with the threaded spindle nut 10 upon rotation of the threaded spindle 9. The threaded spindle 9 is pivot-mounted in the adjustment housing 8, for example in a shaft bearing 16 on the end of the adjustment housing 8 facing away from the cylinder 6. The threaded spindle nut 10 is guided axially in the adjustment housing 8 and mounted in an axially displaceable manner, for example in a packing 11 that simultaneously seals off the space 5 facing away from the cylinder 6 in the clearance space housing 2 behind the adjusting piston 3 against the interior of the adjustment housing 8.

At the end of the threaded spindle 9 facing away from the adjusting piston 3, the threaded spindle 9 protrudes axially from the adjustment housing 8 and forms a journal to which a drive unit 12 can be connected with which the threaded spindle 9 can be rotated. It is also conceivable, of course, to arrange the drive unit 12 in the adjustment housing 8. Here, the drive unit 12 consists of an electric motor 14 that drives a gear mechanism 13, which gear mechanism 13 is arranged on the threaded spindle 9. Of course, any other suitable drive, such as a pneumatic or hydraulic drive, for example, is also conceivable.

If the drive unit 12, and hence the threaded spindle 9 as well, is rotated, the threaded spindle nut 10 moves axially, whereby the adjusting piston 3 is also moved axially, thus enlarging or reducing the clearance of the piston compressor 15 depending on the direction of rotation.

The threaded spindle nut 10 consists of a plastic nut 20 lying radially on the inside and a radially external nut carrier 21 that can simultaneously also form the connection to the adjusting piston 3. The nut carrier is preferably made of a strong material such as steel, for example, and the plastic nut can be made of a mechanically highly strong (particularly against compressive loads) and tribologically favorable plastic such as polyether ether ketone (PPEK), for example. The threaded spindle nut 10 will now be explained in further detail with reference to FIGS. 2*a* to 2*c*.

As shown in FIG. 2*a*, the nut carrier 21 has an internal thread 22 and the plastic nut 20 has an external thread 23 and an internal thread 24. The external thread 23 of the plastic nut 20 is arranged on the internal thread 22 of the nut carrier 21, for example, screwed therein. The preferably metallic threaded spindle 9 is screwed with its external thread 25 into the internal thread 24 of the plastic nut 20.

To enable use of the threaded spindle drive for the high pulsing loads that occur in a reciprocating compressor and act on the adjusting device 7, it was found that the thread height x of the external thread 25 of the threaded spindle 9 and the thread height y of the internal thread 22 of the nut carrier 21 should each be 50 to 80% of the radial thickness d of the plastic nut 20. The thread height x, y is the respective radial distance between thread base and thread peak.

The power transmission between threaded spindle 9 and threaded spindle nut 10 occurs from the spindle flank surface via the plastic nut 20 to the nut carrier 21, or vice versa. Ideally, the plastic nut 20 is loaded only with compressive stresses. If the thread height were less than 50%, the compressive stresses resulting from the load transmission would rise beyond the load limits of the plastic of the plastic nut 20 on the one hand, and, on the other hand, shear and bending stresses would also occur in addition to the compressive stresses, particularly in the region of the plastic thread peaks, which would lead to the rapid failure of the plastic nut 20. In contrast, if the thread height were greater than 80%, the minimum thickness of the plastic nut 20 in the region of the thread peaks would be exceeded, on the one hand, which might result in the breaking-away of plastic segments. On the other hand, as a result of a nut carrier 21 with an elevated thread height y and as a result of the higher load arm, the bending moment and hence the bending stresses in the metallic thread base of the nut carrier 21 would rise beyond the permissible limit.

Moreover, it was found that the thickness of the plastic layer on the thread flank 26 of the internal thread 24 of the plastic nut 20 should be at least 15% of the thread pitch z1 of the external thread 25 of the threaded spindle 9. To wit, with a thickness of less than 15% thereof, the elasticity of the plastic of the plastic nut 20 in relation to that of the nut carrier 21 would be too little and the effect of a uniform load initiation on all thread windings would be massively reduced. The effective load capacity of the plastic nut 20 would thus be greatly reduced.

With both of these measures, it is achieved that sufficient plastic is present on the thread flank 26 but, at the same time, the thread flank 26 of the plastic nut 20 is supported axially by the internal thread 22 of the nut carrier 21 protruding radially therein. The pulsed loading of the threaded spindle nut 10 leads to a micro-movement between the thread flanks 26 of the internal thread 24 of the plastic nut 20 and the adjacent thread flanks of the external thread 25 of the threaded spindle 9 which, however, do not lead to any wear by virtue of the tribologically favorable material of the plastic nut 20. Simultaneously, by virtue of the elastic plastic of the plastic nut 20, a uniform load application is achieved onto all thread flanks 26 that are in contact, which equalizes the load on the individual thread windings. Through the combination of these features, the threaded spindle drive can withstand the high pulsing loads, which makes it possible to operate the adjusting device 7 continuously without having to fix it in place.

Advantageously, the thread of the threaded spindle drive is self-locking in order to enable the drive to be shut off in phases in which no adjustment of the adjusting device 7 is required. This can be achieved easily in a known manner via the pitch z1 of the external thread of the threaded spindle 9 of the threaded spindle drive.

Preferably, the external thread 23 of the plastic nut 20 has the same pitch z2 as the pitch z1 of the internal thread 24 of the plastic nut 20 in order to enable use of the same manufacturing tools. With different pitches z1 and z2, the plastic thickness and hence the elasticity and load application between the thread flanks 26 that are in contact could be varied along the length of the nut.

The peak angle $\alpha$ of the external thread 25 of the threaded spindle 9 and the peak angle $\beta$ of the internal thread 22 of the nut carrier 21 are advantageously 15 to 30°, preferably 20°. With a peak angle $\alpha$, $\beta$ in this region, the thread flanks 19, 26 form a flexural support of approximately the same strength, which is optimum in terms of material wear with respect to the load distribution.

The peak angles $\alpha$, $\beta$ preferably differ by less than 5° in order to enable the best possible applied load.

To prevent unintentional unscrewing of the plastic nut 20 from the nut carrier 21, an anti-torsion lock 27 can be provided. It can be formed, for example, by radial pins 28 through the nut carrier 21 and the plastic nut 20 as shown in FIG. 2*a*, or by axial pins 29 as shown in FIG. 2*b*. However, a provision can also be made that the anti-torsion lock 27 consists of joining nut carrier 21 and plastic nut 20 together in a rotationally fixed manner by an adhesive layer applied therebetween.

A provision can also be made that the nut carrier 21 can be extrusion-coated with plastic at least radially on the inside by means of an injection molding process in order to form the plastic nut 20, and at the same time, radial depressions 30 in the nut carrier 21 can be filled with plastic which then function as an anti-torsion lock 27 as depicted in FIG. 2*c*.

In the adjusting piston 3, a pressure equalization device 31 can also be provided in order to prevent high pressure from being trapped in the space 5 behind the adjusting piston 3 that puts the adjusting device 7 under a load during adjustment.

The pressure equalization device 31 can be embodied as a simply operating piston ring 32 as shown in FIGS. 3*a* and 3*b*. "Simply operating" means, as is known, that the piston ring only forms a seal on one axial front surface, whereas pressure equalization grooves 33 are provided on the opposing front surface in the piston ring 32 (FIG. 3*b*) or pressure equalization grooves 34 in the piston ring groove 35 in the adjusting piston 3 (FIG. 3*a*). Because the piston ring 32 has axial play in the piston ring groove 35, upon movement of the adjusting piston 3 in the direction of the adjusting device 7, a path opens up through the pressure equalization groove 34 and the piston ring groove 35, whereby the pressure in the space 5 can even out.

The pressure equalization device 31 can also be embodied as a non-return valve 36 in the adjusting piston 3, preferably in combination with a two-way piston ring 38 (FIG. 3*c*). A continuous recess 37 is provided for this purpose in the adjusting piston 3 that connects the space 4 in front of and the space 5 behind the adjusting piston 3. As is known, "two-way" means that the piston ring 38 forms a seal on both axial front surfaces. The recess 37 is closed on the end facing toward the space 4 in front of the adjusting piston 3 by a pre-tensioned valve element 39 of the non-return valve 36. If pressure builds up in the space 5 behind the adjusting piston 3 that exceeds the pretension of the valve element 39, the non-return valve 36 opens, whereby the pressure in the space 5 can even out.

In an alternative embodiment, the adjusting device 7 can also be embodied as described below with reference to FIG. 4. Here, the spindle drive of the adjusting device is embodied with an axially displaceable threaded spindle 9 and an axially non-displaceable threaded spindle nut 10. The threaded spindle nut 10 is pivot-mounted in the adjustment housing 8 and is driven, i.e., rotated, by a drive unit 12. For this purpose, a gearwheel 40 can be arranged on the threaded spindle nut 10 that cooperates with a toothed wheel in the gear mechanism 13 of the drive unit 12. As will readily be understood, the threaded spindle nut 10 can of course also be rotated by the drive unit 12 in a wide variety of other ways. Here, the threaded spindle 9 that is displaced axially upon rotation of the threaded spindle nut 10 is connected to the adjusting piston 3, e.g., directly or via a connecting part 17. In this way, through rotation of the threaded spindle nut 10, the position of the adjusting piston 3 in the clearance space housing 2, and hence the clearance of the reciprocating compressor, can be adjusted.

The invention claimed is:

1. An adjusting device for moving an adjusting piston located in a variable clearance space of a piston compressor so as to regulate the capacity of the compressor, the adjusting device comprising:

a threaded spindle having external threads which have a thread height x and which are separated by a pitch z1, a threaded spindle nut which includes an outer nut carrier having internal threads with a thread height y, and an inner plastic nut having external threads engaged with the internal threads of the nut carrier and internal threads engaged with the external threads of the threaded spindle, the internal threads of the plastic nut being separated by the pitch z1, the plastic nut having a radial thickness d and wherein plastic material between outer and inner thread recesses therein has a thickness p, and wherein the thread height x and the thread height y are each 50 to 80% of the radial thickness d, and the plastic thickness p is at least 15% of the thread pitch z1.

2. The adjusting device according to claim 1, wherein the external threads of the threaded spindle define a thread angle α, wherein the internal threads of the outer nut carrier define a thread angle ß, and wherein each of the thread angles α and ß are between 15 and 30°.

3. The adjusting device according to claim 2, wherein each of the thread angles α and ß are 20°.

4. The adjusting device according to claim 2, wherein the thread angles of α and ß differ by less than 5°.

5. The adjusting device according to claim 1, including an anti-torsion lock which connects the nut carrier with the plastic nut.

6. The adjusting device according to claim 5, wherein the anti-torsion lock includes a plurality of pins which extend between the nut carrier and the plastic nut.

7. The adjusting device according to claim 1, including a drive unit for rotating the threaded spindle or the threaded spindle nut.

8. A reciprocating compressor which defines a cylinder and a variable clearance space, and which includes a clearance space housing containing an axially-movable adjusting piston and an adjusting device as defined in claim 1 connected to the adjusting piston.

9. The reciprocating compressor as set forth in claim 8, including a pressure equalization device in the adjusting piston in order to even out the pressure in a space the adjustment housing facing away from the cylinder.

10. The reciprocating compressor as set forth in claim 9, wherein the pressure equalization device comprises a one-way piston ring on the adjusting piston.

11. The reciprocating compressor as set forth in claim 9, wherein the pressure equalization device comprises a non-return valve in the adjusting piston.

12. The reciprocating compressor as set forth in claim 11, including a two-way piston ring in the adjusting piston.

* * * * *